United States Patent [19]

Baldwin et al.

[11] 4,119,523

[45] Oct. 10, 1978

[54] PROCESSES FOR THE PRODUCTION OF DEASHED COAL

[75] Inventors: Roger A. Baldwin, Warr Acres; John L. Bills, Oklahoma City, both of Okla.

[73] Assignee: Kerr-McGee Corporation, Oklahoma City, Okla.

[21] Appl. No.: 716,550

[22] Filed: Aug. 23, 1976

[51] Int. Cl.[2] ..... C10G 1/06

[52] U.S. Cl. ..... 208/8

[58] Field of Search ..... 208/8, 10

[56] References Cited

U.S. PATENT DOCUMENTS

| | | | |
|---|---|---|---|
| 3,583,900 | 6/1971 | Gatsis | 208/8 |
| 3,607,716 | 9/1971 | Roach | 208/8 |
| 3,791,956 | 2/1974 | Gorin et al. | 208/8 |
| 4,028,219 | 6/1977 | Baldwin et al. | 208/8 |

*Primary Examiner*—Delbert E. Gantz
*Assistant Examiner*—James W. Hellwege
*Attorney, Agent, or Firm*—William G. Addison

[57] ABSTRACT

An improved coal deashing process wherein soluble dissolved coal present in the ash concentrate product stream from a critical solvent deashing process can be separated and recovered from the ash concentrate by at least two alternate processing systems.

In one such system, the ash concentrate (containing dissolved and undissolved coal) is admixed with a suitable organic solubilizing solvent to obtain partial redissolution, at elevated temperature and at pressures of atmospheric and above, and thereafter subjecting said mixture to a separation treatment. The liquid product thus separated, containing substantially all of the dissolved coal and only a minor amount of mineral ash, thereafter is recycled to the initial coal dissolution step to thereby provide a portion of the initial solvent necessary for preparation of the coal feed.

In the alternate process, the ash concentrate (containing dissolved and undissolved coal) is again partially redissolved by admixing with a suitable organic solubilizing solvent, at elevated temperature and at pressures of atmospheric and above, and thereafter subjecting said mixture to exact and precise separation treatment. Said separation treatment being designed to effect a clean separation of coal liquefaction products from solids to thereby produce, after removal of the solvent, a deashed coal product having a low sulfur content and less than 0.15 weight percent of mineral ash.

6 Claims, 4 Drawing Figures

PROCESSES FOR THE PRODUCTION OF DEASHED COAL

BACKGROUND OF THE INVENTION

1. Field of the Invention

Considerable research and development effort currently is under way in an effort to develop commercially practical processes for upgrading coals (bituminous, subbituminous and lignite) to provide a more ecologically acceptable product, that is, a product having both a low sulfur and a low ash content. However, many of the current conversion processes suffer from inadequate separations of mineral matter (sulfur containing ash values).

The present invention relates generally to coal deashing processes and, more particularly, but not by way of limitation, to improved recovery and utilization of coal liquefaction products in coal deashing processes.

2. Description of the Prior Art

Various processes, including gasification, liquefaction, pyrolysis and combinations of these processes have been investigated. One promising process is referred to as the Solvent Refined Coal process. This process includes solvent extraction and comprises dissolving ground coal in solvent, in the presence of hydrogen, to provide a mixture comprising (1) dissolved coal, (2) solid, insoluble coal values and (3) solid, insoluble mineral matter of ash. Separation of the dissolved coal from the solid, insoluble materials has proved to be arduous and costly when attempted using either filtration devices or hydroclones, for example.

Moreover, even when such separation attempts have been successful, it has been found that the recovered dissolved coal frequently has an ash content considerably higher than desired. An ash content of 0.16 weight percent or less in the dissolved coal is desirable since, with such a low ash level, it is possible to burn such low-ash containing dissolved coal in electric power plants or the like without the necessity of installing costly fly-ash removal equipment for the stack-gases. Further, a low sulfur content is desired since this precludes the need to install sulfur abatement devices such as stack gas units to remove sulfur dioxide.

It also has been found that when filters or hydroclones are used as separation devices that an undesirably large amount of dissolved coal may remain either in the filter cake or hydroclone underflow with the separated ash. It has been suggested that such filter cake or hydroclone underflow be used as a feed for a hydrogen generation plant because of the carbon content of the contained coal values. This is uneconomical, however, because of the relatively high content of dissolved coal.

Many other prior art separation processes have been found to be impractical. Some depend upon the utilization of unusual or especially prepared coal dissolving solvents, see for Example U.S. Pat. No. 3,867,275. Further, such dissolving solvents are expensive since they frequently are generated from various high cost petroleum fractions rather than being derived from lower cost coal. Clearly, solvent derived from coal is preferred to that derived from petroleum.

Other prior art processes have proved to be economically unsuitable because they require treatment of the entire dissolver effluent with a second liquid intended to enhance or promote separation of undesirable solid materials from the dissolved coal. One disadvantage of such processes lies in the fact that large volumes of dissolver effluent have to be treated.

In one prior art process, a special kerosene fraction is prepared via a controlled hydrogenation step, see U.S. Pat. No. 3,852,182; 3,852,183 and 3,856,675. Use of such solvents requires relatively long settling rates.

Another process, U.S. Pat. No. 3,791,956, requires the use of solvents such as n-decane, cyclohexane or decalin, all of which are expensive and result in processes which do not appear to be economical.

Successful processes for the deashing of coal utilizing critical solvent techniques are disclosed in U.S. Pats. Nos. 3,607,716 and 3,607,717, which patents are assigned to the same assignee as the present invention. In one such process, following the initial dissolution of particulate coal in suitable solvents, in the presence of hydrogen and at elevated temperatures and pressures, gaseous products and very light hydrocarbon fractions are separated from the dissolver effluent which then is advanced directly to a vacuum stripping tower. Overheads from that tower can be fractionated to separate contained light hydrocarbons from the solvent. The light hydrocarbons may be utilized for known purposes and the solvent can be recycled to the initial dissolution step.

Still bottoms from the vacuum tower, containing the mineral matter, then are advanced to a critical solvent deashing section. In that section, the vacuum still bottoms are mixed with a light organic "deashing" solvent. Thereafter, under suitable conditions of elevated temperature and pressure, a first stage ash concentrate fraction is separated. Subsequently, at even higher temperatures but at essentially constant pressure, deashed coal is recovered from a second stage.

It has been determined that under certain critical solvent deashing operating conditions, in the deashing section, that the first stage ash concentrate contains a significant quantity of dissolved coal values. Generally, it would be desirable to use the ash concentrate as a feed to a hydrogen plant. However, this is uneconomical because of the quantity of soluble coal values present in the ash concentrate.

SUMMARY OF THE INVENTION

It now has been discovered that the soluble dissolved coal present in the ash concentrate can be recovered from the ash concentrate by at least two alternate processing systems. In each, recovery of the dissolved coal from the ash concentrate is effected at extraction temperatures ranging up to only about 400° F. and at extraction pressures from essentially atmospheric up to only about 300 p.s.i.g.

More particularly, in one of the process alternatives, the ash concentrate (containing dissolved and undissolved coal) obtained in the critical solvent deashing section is partly redissolved in an organic solubilizing solvent. The resulting slurry is subjected to separation utilizing for example, filters, hydroclones, centrifuges or the like. In accordance with this invention, such separation need not be exact since it is intended to effect only a further concentration of the ash values and, in fact, to leave only enough carbon (as dissolved and undissolved coal) required to provide a feed for a hydrogen generation plant. The liquid exiting from the separator contains substantially all of the dissolved coal and only a minor amount of mineral ash. In accordance with this invention, that liquid is recycled to the initial coal dissolution step at the beginning of the process to thereby provide a portion of the initial coal dissolving solvent for preparing the feed coal slurry.

This recycled stream serves to replace a portion of the overheads from the vacuum tower normally recycled to the initial dissolving step. The overheads so replaced then may be used as a separate product stream or they may be blended with the deashed coal produced in the second stage of the critical solvent deashing section to provide a product having, for example, a reduced softening point.

The solids remaining in the separator are treated to recover the solvent therefrom for re-use and leave a mixture of ash and undissolved coal which is an economical feed to a hydrogen generation plant.

In accordance with the other alternate process of the present invention, the ash concentrate (containing dissolved and undissolved coal) produced in the critical solvent deashing section again is partially redissolved in an organic solubilizing solvent. However, in this alternate process the solvent is chosen to permit an exact and precise separation of dissolved coal from undissolved coal and mineral ash. Thereafter, the resulting slurry is subjected to a separation step designed to effect a clean separation of liquids from solids.

With the choice of an appropriate organic solubilizing solvent, it is possible to filter or otherwise treat the slurry to provide a mineral matter filter cake containing very little dissolved coal. The product remaining after removal of the solvent is a deashed coal product containing less than 0.15 weight percent of mineral ash as well as solvent. Such solvent is separated from the deashed coal by suitable means and recycled for re-use in the process. The deashed coal so separated then is combined with the deashed coal separated in the critical solvent deashing section of the process to increase the yield of a soluble coal product having low sulfur and mineral ash content. As will be apparent to those skilled in the art, such deashed coal product provides an ecologically acceptable boiler fuel satisfying state and federal clean air standards.

The mineral matter-containing solids remaining in the separator are treated to recover the solvent therefrom for re-use and leave a mixture of ash and undissolved coal which is an economical feed to a hydrogen generation plant.

DESCRIPTION OF PREFERRED EMBODIMENTS

Figure 1:
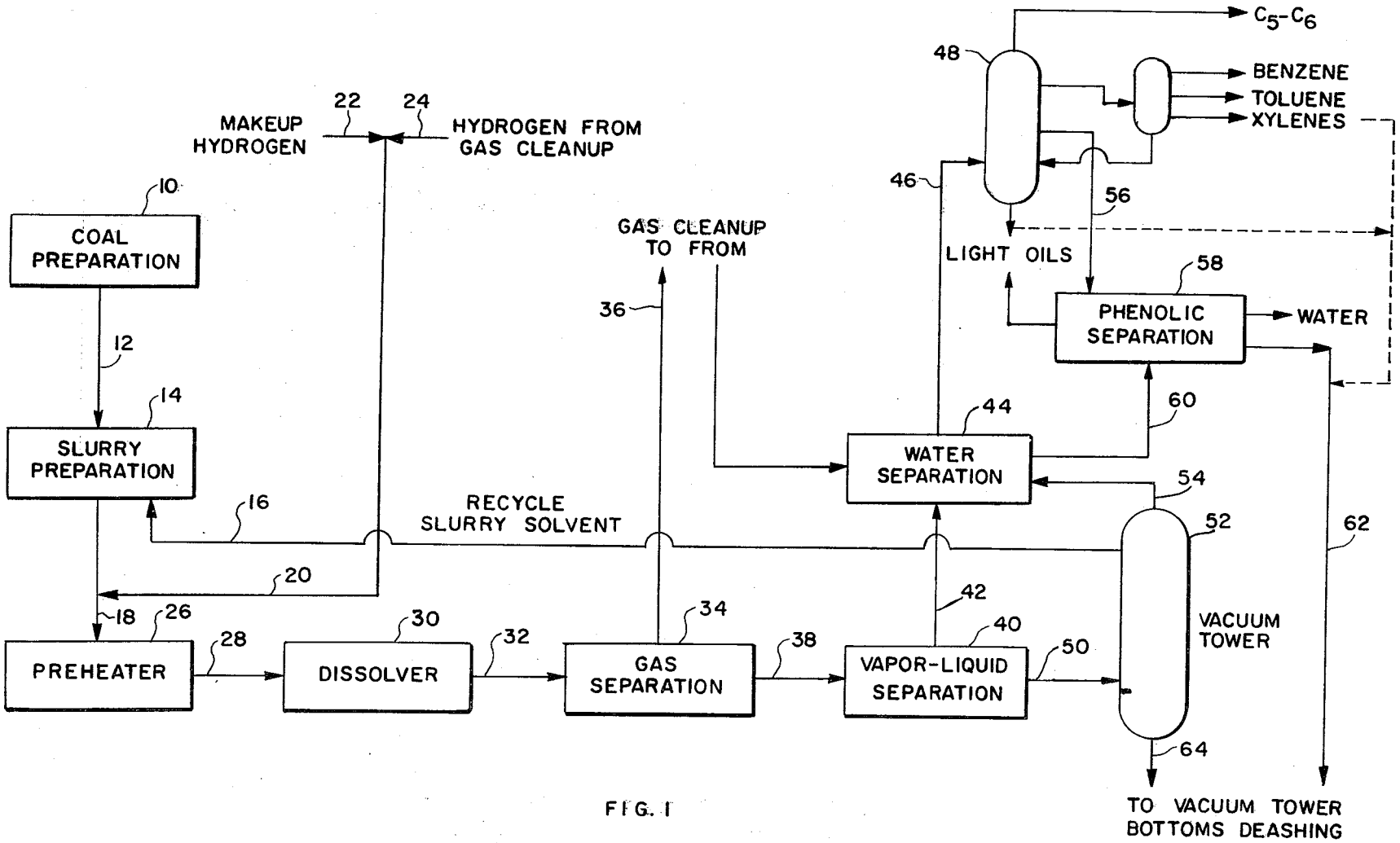
FIG. 1 is a schematic illustration of a process for dissolving coal.

Looking at FIG. 1 of the drawing, there is illustrated a tank 10 in which coal, dried to less than about three weight percent moisture and ground to less than about one-eighth inch, preferably about −100 mesh or less, is stored. Such coal is conveyed through a line 12 to a slurry preparation vessel 14 wherein it is admixed with recycle coal dissolving solvent introduced through a line 16. If desired, the recycle solvent may be catalytically hydrogenated, by known processes, to increase its content of hydrogen donor compounds. Make-up solvent may be introduced into line 16, as required.

The slurry of ground coal and recycle coal dissolving solvent is heated to from about 350° to about 450° F. in slurry preparation vessel 14 to impact desired pumping characteristics. The weight ratio of solvent to coal should be within the range of from about 2 to about 6, preferably from about 2.0 to about 3.5, parts by weight of solvent for each part by weight of coal.

The warm, pumpable slurry of coal and coal dissolving solvent is advanced under pressure through a line 18 in which it is mixed with pressurized hydrogen introduced through a line 20. The hydrogen conveniently may be obtained from an off-gas cleanup plant through a line 24 or it may comprise make-up hydrogen from a line 22 generated in the practice of this invention. If desired, a synthesis gas, which is a mixture of hydrogen and carbon monoxide, may be used instead of hydrogen.

The hydrogen-containing coal slurry then is passed into a preheater 26 wherein it is heated to a temperature of from about 750° to about 850° F. The system pressure may range from about 1000 to about 5000 p.s.i.g.

The preheated and pressurized slurry then is conveyed through a line 28 to a dissolver vessel 30. In that vessel, which is operated at from about 750° to about 850° F., a large portion of the coal values are dissolved in the solvent. Residence time in the dissolver vessel 30 may vary from about 5 to about 60 minutes, generally from about 30 to about 45 minutes. The pressure in the vessel preferably is maintained within about 1250 to about 3000 p.s.i.g.

The resultant slurry then is conveyed through a line 32 to a high pressure gas separation vessel 34. Excess hydrogen, oxides of carbon, hydrogen sulfide and other gaseous coal conversion products are separated in vessel 34 and conveyed through a line 36 to a cleanup plant (not shown) for recovering hydrogen for recycle in the system. The gas separation vessel is operated at a pressure of from about 1000 to about 2500 p.s.i.g.

The largely gas-free coal slurry then is conveyed from separation vessel 34 through a line 38 to a vapor-liquid separation vessel 40. That vessel is operated at temperatures up to about 600° F. and at pressures as low as atmospheric. Light liquids separate in vessel 40 and are conveyed through a line 42 to a water separation vessel 44 and then through a line 46 to a light liquids separating unit 48.

The slurry remaining in separation vessel 40 is conveyed through a line 50 to a coal dissolving solvent recovery tower 52 such as a still or a tower operated under vacuum, for example, at a pressure of from about 1 to about 5 p.s.i.g. and a bottom temperature of about 500° to about 600° F. Coal dissolving solvent is recovered in tower 52 and is recycled through line 16 to slurry preparation vessel 14. Also, light liquids are recovered in tower 52 and are conveyed through a line 54 to a water separator 44 and then to a light liquids separating unit 48.

The feeds to light liquids separating unit 48 are separated, by means outside the scope of this invention, into a number of products such as pentane, benzene, toluene, xylenes and other distillates boiling between about 350° and about 550° F. A phenolics rich fraction is withdrawn from the separation unit 48 and passed through a line 56 into a phenolic separator unit 58. Water from separator 44 is conveyed through a line 60 and introduced into the phenolic separator unit 58. Therein, a mixture of phenols, cresols and xylenols is recovered and conveyed through a line 62 to a critical solvent deashing unit, shown in FIG. 2.

Figure 2:
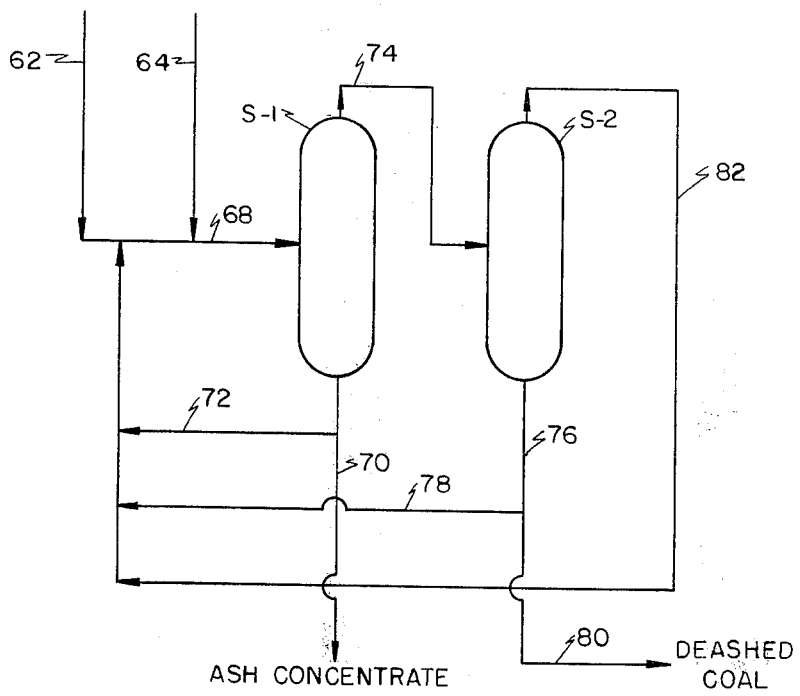
FIG. 2 is a schematic illustration of a critical solvent deashing unit.

The hot vacuum tower bottoms, substantially free of coal dissolving solvent but containing the dissolved coal; solid, insoluble mineral ash and solid, insoluble coal components of the feed coal then are advanced through a line 64 to a critical solvent deashing unit, shown in FIG. 2.

The foregoing procedure for dissolving coal is set forth by way of illustrating only one of several suitable coal dissolution or solubilization methods which can be used in practicing the present invention. Another suitable solubilizing procedure is that including an ebullated bed of particulate catalyst.

Turning now to FIG. 2, a critical solvent deashing process is illustrated depicting a method for separating solid, insoluble mineral ash and solid, insoluble coal components from dissolved coal contained in the hot vacuum tower bottoms conveyed through line 64. Such material is introduced into a line 68 and admixed with deashing solvent introduced through a line 62. The weight ratio of deashing solvent to vacuum tower bottoms should be within the range of from about 1.0 to 6, preferably from about 1.7 to 3 parts by weight of deashing solvent for each part by weight of vacuum tower bottoms. The resulting mixture is introduced, at a pressure of about 750–1000, preferably about 800 p.s.i.g. and a temperature of about 450°–630° F., into the first of a pair of settlers or separators, S-1 and S-2.

Figure 3:
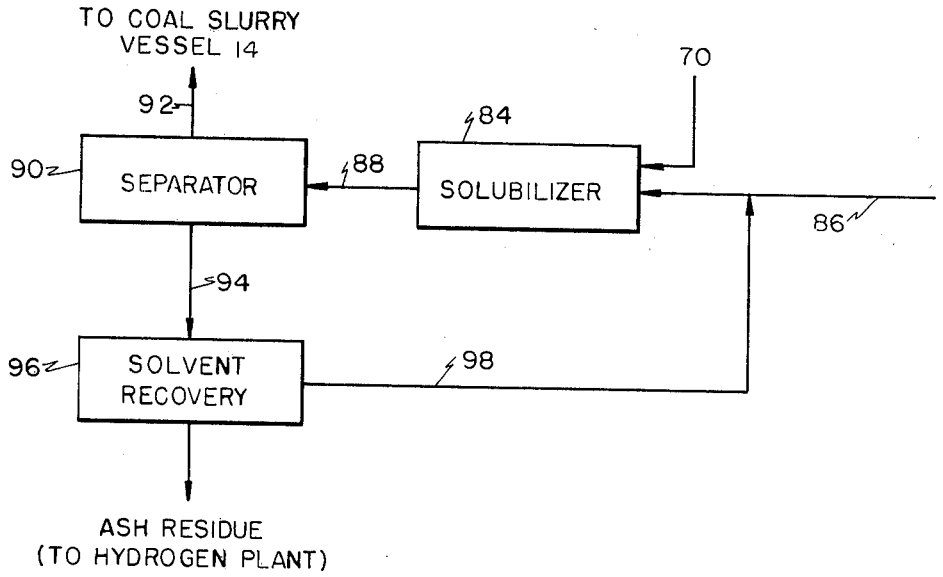
FIG. 3 is a schematic illustration of one aspect of the process of the present invention for upgrading ash concentrate.
Figure 4:
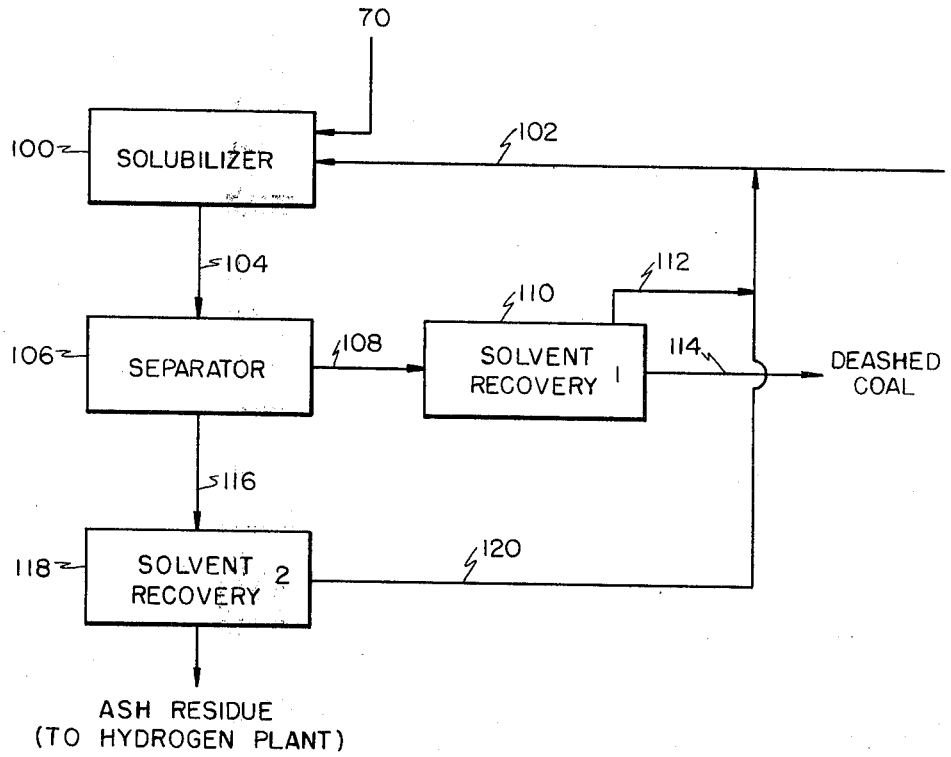
FIG. 4 is a schematic illustration of another aspect of the process of the present invention for upgrading ash concentrate.

In S-1, two phases separate: (1) a light upper phase comprising deashing solvent and dissolved coal and (2) a heavier lower phase comprising solid, insoluble mineral ash; solid, undissolved coal; dissolved coal and a minor amount of deashing solvent. The heavy phase is withdrawn from the lower portion of S-1 through a line 70. Deashing solvent present in that heavy phase is flashed off and passed through a line 72 and recycled for reintroduction into the system through a line 68. The remaining solid, insoluble mineral ash; solid, insoluble undissolved coal and dissolved coal (hereinafter called "ash concentrate") is treated, as will be disclosed hereinafter, as shown in FIGS. 3 and 4.

The light phase formed in S-1 is withdrawn through a line 74 and passed into the second separation vessel S-2. The temperature of this light phase material is increased from about 600 to about 850° F. (preferably from about 630° to about 700° F.) while the pressure is maintained at about 750°–1000, preferably about 800 p.s.i.g. In S-2, a second phase separation occurs with a light phase rising to the top of vessel S-2 and a heavy phase settling to the bottom. The heavy phase is withdrawn through a line 76 concurrently with a reduction in pressure maintained on that phase. As a consequence of such reduction in pressure, deashing solvent is flashed off and recycled through a line 78 and recycled for reintroduction into the system through the line 68. The remaining solvent-free material, that is, the molten deashed soluble coal product, then is passed through a line 80 from whence it is cooled and prepared for sale.

If desired, the deashed soluble coal product may be advanced directly through the line 80 to an electrical power generator station (not shown) or other operation requiring a low ash, low sulfur fuel. The ash content of the deashed coal product typically will be about 0.15 weight percent or less and the sulfur content will be less than 1%.

The light phase formed in the top of S-2 is withdrawn through line 82 and recycled to line 68 as deashing solvent for re-use in the system.

FIG. 3 is a schematic illustration of one aspect of the process, in accordance with the present invention, for removing substantial quantities of mineral ash from the ash concentrate material passing through a line 70, FIGS. 2 and 3. Specifically, the ash concentrate material passing through line 70 is introduced into a solubilizer 84 (see FIG. 3) wherein it is admixed with a solubilizing solvent (to be described more fully hereinafter) introduced through a line 86. The weight ratio of incoming solubilizing solvent to ash concentrate may range from about 2 to 6, or greater, parts by weight, and preferably from about 2½ to 5 parts by weight of solvent for each part by weight of ash concentrate. The temperature in solubilizer 84 is maintained within a range of from about 190° F. to about 400° F. and the pressure is maintained within a range from about atmospheric up to about 300 p.s.i.g. The ash concentrate and solubilizing solvent are admixed in vessel 84 for a period of time of from about five minutes to about one hour.

Thereafter, the resultant slurry of ash concentrate in solubilizing solvent is passed through a line 88 to an ash separator 90 which may comprise an hydroclone; rotary, precoated filter; plate filter or the like. The overflow or filtrate produced in the separator 90, comprises principally dissolved coal and solubilizing solvent with some solid, insoluble mineral ash. This material is recycled through a line 92 to slurry preparation vessel 14 (FIG. 1).

The underflow or filter cake produced in separator 90 is passed through a line 94 to a solvent recovery vessel 96. In vessel 96 solubilizing solvent is flashed off and passed through a line 98 for re-use in solubilizer 84. The material remaining in solvent recovery vessel 96 is principally solid, insoluble mineral ash and undissolved coal with some dissolved coal. The carbon values contained in these solids render the material an excellent feed for a hydrogen plant to produce some or all of the hydrogen required for the dissolution of the feed coal initially introduced into the process.

FIG. 4 is a schematic illustration of another method for upgrading the ash concentrate passing through line 70. In accordance with the process shown in FIG. 4, ash concentrate passing through line 70 is introduced into a solubilizer 100. Solubilizing solvent (to be described more fully hereinafter) is introduced into solubilizer 100 through a line 102. The weight ratio of incoming second solvent to ash concentrate may range from about 2 to about 6, preferably from about 2½ to about 5 parts, by weight of solubilizing solvent for each part by weight of ash concentrate. The temperature in the solubilizer vessel 100 may range from about 190° F. to about 400° F. and the pressure may range from approximately atmospheric up to about 300 p.s.i.g.

The solubilizing solvent and ash concentrate are mixed in solubilizer 100 for a period of time from about five minutes to about one hour after which the resulting slurry is passed through a line 104 into a separator 106 which again may comprise an hydroclone; rotary, precoated filter; plate filter or the like. The primary difference in function between separator 106 (FIG. 4) and separator 90 (FIG. 3) is that separator 106 is operated in a much more precise manner. That is, for example, if separator 106 is a filter it should be operated so as to effect substantially complete removal of the mineral ash, for example, by using highly efficient filter media.

The overflow or filtrate produced in the separator 106 comprises principally dissolved coal and solubilizing solvent with only a minor amount of solid, insoluble mineral ash. The material is conveyed through a line 108 to a solvent recovery vessel 110, which may comprise a distillation apparatus, wherein solubilizing solvent is recovered and recycled through a line 112 for reintroduction into solubilizer 100. The remaining substantially completely deashed coal is passed through a line 114 for blending with deashed coal obtained from the second stage of the critical pressure solvent deashing unit S-2, shown in FIG. 2.

The underflow or filter cake produced in separator 106 is conveyed through a line 116 to a solvent recovery vessel 118. Solubilizing solvent recovered in vessel 118 is conveyed through a line 120 for reintroduction into solubilizer 100. The solvent-free material produced in solvent recovery unit 118 comprises essentially solid, insoluble mineral ash and undissolved coal containing some dissolved coal. The carbon values contained in these solids render the material an excellent feed for a hydrogen plant to produce some or all of the hydrogen required for the dissolution of the feed coal initially introduced into the process.

The coal dissolving solvents used in dissolving the coal initially in slurry preparation vessel 14 include cyclic hydrocarbons having normal boiling points of about 400°–1,000° F., and preferably polycyclic hydrocarbons containing at least two condensed rings. Polycyclic hydrocarbons having an aromatic-naphthenic fused ring structure wherein a benzenoid ring and a nonbenzenoid or a naphthenic ring adjacent thereto are fused are especially useful. Specific examples of solvents include fused ring aromatic hydrocarbons containing two, three and four fused benzene rings such as tetralin, decalin, diphenyl, methylnaphthalene, dimethylnaphthalene, fluorene, anthracene, phenanthrene, pyrene and chrysene. Typically, coal derived dissolving solvents contain these compounds as well as many isomeric compounds, similar polycyclic compounds and various alkylated derivatives. In addition, such solvents contain various heterocyclic oxygen, nitrogen, and sulfur compounds. Other common components are a range of phenolic compounds. Such solvents can also be catalytically hydrogenated to increase their contents of useful hydroaromatic components (i.e., the so-called hydrogen donor compounds).

The deashing solvents are light organic solvents having critical temperatures below 800° F., and preferably below 750° F. These solvents comprise one or more substances selected from the following groups:

1. Hydrocarbons:

a. Aromatic hydrocarbons having a single benzene nucleus and preferably 6–9 carbon atoms, such as benzene, toluene, o-, m-, and p- xylene, ethyl benzene, n-propyl or isopropyl benzene, and monocyclic aromatic hydrocarbons in general having normal boiling points below about 310° F., and b. Cycloparaffin hydrocarbons which preferably contain 4–9 carbon atoms, such as cyclobutane, cyclopentane, cyclohexane, cycloheptane, and nonaromatic monocyclic hydrocarbons in general having normal boiling points below about 310° F.

2. Amines, including the following:

a. Mono-, di-, and tri-open chain amines which preferably contain about 2–8 carbon atoms, such as ethyl, propyl, butyl, pentyl, hexyl, heptyl, and octylamines;

b. Carbocyclic amines having a monocyclic structure and preferably containing approximately 6–9 carbon atoms, such as aniline and its lower alkyl homologs wherein the alkyl groups contain about 1–3 carbon atoms and up to 3 alkyl groups are present on each monocarbocyclic structure; and c. Heterocyclic amines and preferably those containing about 5–9 carbon atoms such as pyridine and its lower alkyl homologs wherein the alkyl groups contain approximately 1–4 carbon atoms and up to three alkyl groups are present on each hetercyclic structure.

3. Phenol and its lower alkyl homologs, and preferably phenols having 6–9 carbon atoms. The alkyl groups may contain, for example, 1–3 carbon atoms and up to three alkyl groups may be present on each phenolic nucleus.

Additional light organic solvents suitable as deashing solvents include one or more substances from the following groups:

4. Open chain mono-olefin hydrocarbons having normal boiling points below about 310° F. and preferably containing about 4–7 carbon atoms, such as butene, pentene, hexene, and heptene, and 5. Open chain saturated hydrocarbons having normal boiling points below about 310° F. and preferably containing about 5–8 carbon atoms such as pentane, hexane, heptane and octane.

Preferred deashing solvents include benzene, toluene, xylene, homologs and isomers thereof, as well as mixtures thereof. Other preferred solvents include light aromatic extracts of reformate obtained by extracting a catalytic reformate by a number of commercial processes including the UDEX process, and aromatic or phenolic cuts in general which have critical temperatures below 800° F., including those derived from the destructive distillation of coal or coal tar and light oils. Reformates from light distillates obtained from coal liquefaction processes are particularly suitable for use as deashing solvents in accordance with this invention. Still other commercially available mixtures including one or more of the foregoing classes of compounds may be employed, and in many instances the mixture need not be purified prior to use.

The solubilizing solvent used in the partial redissolution of the ash concentrate in solubilizer vessel 84 or vessel 100, as contemplated in this invention, is at least one solvent selected from the group consisting of pyridine, cresols, pyrrolidine or anthracene oil.

The following examples illustrate the importance of selecting a proper solubilizing solvent for use in each of the alternate processes of the present invention.

Table I below sets forth data from six examples illustrating the results obtained by practicing the present process using four different solvents. Specifically, ash concentrate obtained from the first separator of the critical solvent deashing section was used as the feed material. In each example, the feed material was mixed with the solvent as indicated in Table I. The resulting mixtures, in each example were treated using a Soxhlet apparatus and procedure as described in *GENERAL LABORATORY TECHNIQUES* by Philip Perlman, M.S., 1964, Franklin Publishing Company, Inc., pages 134–135, incorporated herein by reference. More particularly, in each of the examples, about 10 grams of ash concentrate were placed in a porous thimble which, in turn, was placed in the Soxhlet apparatus. About 250 grams of the selected solvent were placed in the flask and heated. Vaporized solvent passed upwardly through the apparatus where it was condensed and allowed to drip downwardly onto the coal maintained in the thimble. Dissolved coal and solvent "weeped" through the side wall of the thimble and collected in the apparatus until it overflowed the syphon and flowed downwardly to collect in the flask. Solids remained in the thimble. Extraction was continued for the period of time specified in the Table.

TABLE I

Solubility of Ash Concentrate
Soxhlet Extractions

| Example No. | Solvent | Hours Extracted | Ash, Wt. % Before | Ash, Wt. % After |
|---|---|---|---|---|
| 1. | Benzene | 92 | 32.7 | 36.2 |
| 2. | Benzene | 96 | 35.6 | 38.3 |
| 3. | Xylenes | 74 | 35.6 | 36.9 |
| 4. | Acetone | 48 | 35.6 | 37.6 |
| 5. | Pyridine | 138 | 35.6 | 57.7 |
| 6. | Pyridine | 28 | 32.4 | 44.6 |

As shown in Table I, the solids remaining in the thimble, in each example, were measured after each extraction. It will be noted that pyridine was the only one of the four solvents that functioned effectively as a solubilizing solvent to extract mineral ash from the ash concentrate.

A series of bench top digestions was performed using a wide range of solvents as well as mixtures of solvents. These digestions are illustrated in Table II below.

TABLE II

Solubility of Ash Concentrate
Bench Top Digestions

| Example No. | Solvent | Hours Digested | Temp. ° F. | Sol./CoaL Wt. Ratio | Ash, Wt. % Before | Ash, Wt. % After |
|---|---|---|---|---|---|---|
| 7. | Cresols[a] | ~1 | ,22 ~330 | ~2.0 | Could not filter | |
| 8. | Cresols[a] | ~1 | ~330 | ~5.0 | 32.4 | 55.2 |
| 9. | Quinoline | ~1 | ~338 | ~5.0 | Could not filter | |
| 10. | 1-Hexanol | ~1 | ~298 | ~5.0 | 32.4 | 34.1 |
| 11. | Tetrahydrofuran | ~1 | ~149 | ~5.0 | 32.4 | 35.6 |
| 12. | n-Butyl acetate | ~1 | ~241 | ~5.0 | 32.4 | 33.2 |
| 13. | Pyrrolidine | ~1 | ~187 | ~5.1 | 32.4 | 53.1 |
| 14. | Triethylamine | ~1 | ~203 | ~5.0 | 32.4 | 32.2 |
| 15. | 1-Methylnaphthalene | ~1 | ~460 | ~5.0 | 32.4 | 38.9 |
| 16. | Anthracene oil | ~1 | ~356 | ~4.6 | 35.6 | 62.0 |
| 17. | 1:1-Xylenes-cresols[b] | ~1 | ~302 | ~3.1 | 32.4 | 36.3 |
| 18. | 1:1-Xylenes-cresols[b] | ~1 | ~293 | ~1.5 | Could not filter | |
| 19. | 1:1-Benzene-cresols[b] | ~1 | ~208 | ~5.2 | 33.3 | 40.7 |
| 20. | 4:1-Benzene-cresols[b] | ~1 | ~199 | ~5.1 | 33.3 | 36.0 |
| 21. | 1:1-Xylenes-cresols[b] | ~1 | ~131 | ~5.0 | 32.4 | 32.6 |

[a]U.S.P. cresol
[b]A mixture of cresols containing 48.9% m-cresol, 11.3% p-cresol, 24.0% 2,4-dimethylphenol, 7.8% 3,4-dimethylphenol, and 7.8% catechol (by weight)

In each example the digestion was continued for a period of one hour under the conditions shown in Table II after which the digested material was filtered while still hot. The filter cake obtained, in each instance, was rinsed with acetone and vacuum dried. The filter cakes then were assayed for their mineral ash content. As will be seen from Table II, only cresols, pyrrolidine and anthracene oil are satisfactory solubilizing solvents for extracting dissolved coal from the ash concentrates to yield an improved ash removal. Additionally, as shown by Example 7, the effectiveness of cresols as a solubilizing solvent is adversely affected by reducing the ratio of solubilizing solvent to ash concentrate from 5 to 2 as well as by diluting the cresols with either benzene or xylenes.

Another series of tests was run to determine the effects of varied temperatures and pressures on the degree of dissolution of ash concentrate in three different solubilizing solvents. These tests were conducted in a rocked 1-liter Parr autoclave. The results of these runs are set forth in Table III below.

TABLE III

Effects of Temperature and Pressure on the Solubization of Ash Concentrate

| Example No. | Solvent | Temp. ° F. | Pressure, psig | Solvent to Coal Wt. Ratio | Ash, Wt. % Before | Ash, Wt. % After |
|---|---|---|---|---|---|---|
| 22 | Benzene | 500 | 650 | 6.4 | 35.6 | 39.8 |
| 23 | Benzene | 500 | 650 | 6.4 | 35.6 | 40.3 |
| 24 | Benzene | 500 | 970 | 6.4 | 35.6 | 40.7 |
| 25 | Benzene | 500 | 1200 | 6.5 | 35.6 | 37.9 |
| 26 | Benzene | 670 | 1100 | 2.2 | 35.6 | 36.1 |
| 27 | Benzene | 650 | 2100 | 6.1 | 33.3 | 36.7 |
| 28 | Xylenes | 655 | 600 | 2.2 | 33.3 | 33.1 |
| 29 | Cresol | 500 | 120 | 6.4 | 32.4 | 53.2 |

In each of Examples 22–29, inclusive, the ash concentrate feed was charged to the autoclave in the form of a fine powder. In Examples 22, 23, 26, 28 and 29 the tests were conducted at the autogenic pressure of the benzene and cresols. In Example 24 nitrogen was used to increase the autogenic gas pressure to 970 p.s.i.g. In Examples 25 and 27 sufficient benzene was employed to insure that the resulting pressure was due largely to the hydraulic expansion of fluid benzene. In each instance, the tests were conducted by rocking the autoclave at the indicated temperatures for one hour. Thereafter, the contents of the autoclave were allowed to settle for a period of time of from about 30 to 60 minutes while maintaining the indicated temperatures. After settling, the contents of the autoclave, in each instance, were cooled to ambient conditions, the autoclave opened and the contents removed therefrom. The contents removed in Examples 22–28 were in the form of a solid mass; the contents removed in Example 29 were in the form of a slurry. In each instance, the solids, after removal of the solvent, were assayed for their ash contents. The data, as set forth in Table III, demonstrate that benzene and xylenes, at elevated temperatures and pressures, do not dissolve any more of the coal contained in the ash concentrate than do such solvents when employed in Soxhlet extractions (Table I) or bench top digestions (Table II).

The data in Table III further demonstrate that in those examples which were conducted at the highest temperatures, the ash content of the autoclave solids is a reliable indicator of the dissolution occurring in those examples. Thus, the material recovered from the autoclave in Example 22 was found to contain 39.8 weight percent ash. The ash from the examples taken at 500° F. and 650 p.s.i.g. (Example 22) is 39.3 weight percent, indicating good agreement.

EXAMPLE 30

A quantity of ash concentrate is introduced into solubilizer 84 as illustrated in FIG. 3. The ash concentrate is mixed with a solubilizing solvent in the approximate proportions of 3 parts solvent for each 1 part of ash concentrate. The solvent is an anthracene oil like distillate having an atmospheric boiling range of about 550° to about 670° F. The resulting mixture is passed to a separator 90, see FIG. 3. The overflow leaving separator 90 contains 32 weight percent solids. Upon removal of the solvent from the overflow, an ash residue containing 60 weight percent is recovered. The overhead stream from separator 90, containing 2.5 weight percent solids, is returned to slurry preparation vessel 14, see FIG. 1, to be used as coal dissolving solvent.

EXAMPLE 31

A quantity of ash concentrate is introduced into solubilizer 84 wherein it is digested with a solubilizing solvent while being maintained at a temperature of from about 300° to about 350° F. The solubilizing solvent comprises mixed cresols. Five parts of solubilizing solvent are employed for each 1 part of ash concentrate. The resulting mixture then is conveyed to separator 90, see FIG. 3, which in this instance is a hydroclone. The overflow from the hydroclone contains about 40 weight percent solids which are advanced to a filter in which entrained soluble coal is washed from the filter cake with fresh solubilizing solvent. The washed solids are flashed to remove solvent to leave an ash residue containing 55 weight percent ash. Recovered solubilizing solvent is recycled to solubilizer 84. The overhead stream leaving separator 90, containing 1.4 weight percent solids, is returned to slurry preparation vessel 14, see FIG. 1, to be used as coal dissolving solvent.

EXAMPLE 32

A quantity of the material prepared in solubilizer 84, (see FIG. 3), as described in Example 31, is filtered and washed with clean, mixed cresols. The solubilizing solvent remaining on the filter cake is removed to provide an ash residue containing about 55 weight percent ash. The filtrate stream then is distilled to recover deashed soluble coal containing less than 0.15 weight percent mineral ash.

While the present invention has been described with respect to what, at present, are believed to be the preferred embodiments thereof, it will be understood, of course, that certain changes, additions, modifications and the like may be made therein without departing from its true scope as defined by the appended claims.

What is claimed is:

1. In a process which comprises preparing coal liquefaction products by contacting coal with dissolving solvent at elevated temperature and pressure, passing the resulting mixture to a still to remove coal dissolving solvent for recirculation and leave still bottoms which are passed to a deashing section in which the bottoms are contacted with deashing solvent under suitable conditions of elevated temperature and pressure to form an ash concentrate, the improvements which comprise:

(a) admixing said ash concentrate with a solubilizing solvent comprising at least one solvent selected from the group consisting of pyridine, cresols, pyrrolidine, anthracene oil or admixtures thereof in a solubilizer treatment zone, (b) maintaining the temperature in said solubilizer treatment zone within a range of from about 190° F. to about 400° F. and the pressure in said solubilizer treatment zone within a range of from about atmospheric to about 300 psig, (c) subjecting said admixture to a separation treatment to separate at least two phases, (i) a light phase comprising principally dissolved coal; solubilizing solvent; and some solid, insoluble mineral ash and (ii) a heavy phase comprising substantially solid, insoluble mineral ash; solid insoluble undissolved coal; and some solubilizing solvent, (d) subjecting the heavy phase to solvent recovery treatment for recycle of the solubilizing solvent and recovery of the solid, insoluble mineral ash and solid, insoluble undissolved coal, and (e) recycling the light phase to supplant a portion of the coal dissolving solvent.

2. The process of claim 1 wherein:

the weight ratio of solubilizing solvent to ash concentrate is within the range of from about 2 to about 6 parts by weight of solvent for each part by weight of ash concentrate.

3. The process of claim 1 wherein:

the weight ratio of solubilizing solvent to ash concentrate is within the range of from about 2½ to about 5 parts by weight of solvent for each part by weight of ash concentrate.

4. In a process which comprises preparing coal liquefaction products by contacting coal with dissolving solvent at elevated temperature and pressure, passing the resulting mixture to a still to remove coal dissolving solvent for recirculation and leave still bottoms which are passed to a deashing section in which the bottoms are contacted with deashing solvent under suitable conditions of elevated temperature and pressure to form an ash concentrate, the improvements which comprise:

(a) admixing said ash concentrate with a solubilizing solvent comprising at least one solvent selected from the group consisting of pyridine, cresols, pyrrolidine, anthracene oil or admixtures thereof in a solubilizer treatment zone at elevated temperature and pressure, (b) maintaining the temperature of said solubilizer treatment zone within a range of from about 190° F. to about 400° F. and the pressure of said solubilizer treatment zone within a range of from about atmospheric to about 300 psig, (c) subjecting said admixture to an exact and precise separation treatment to separate at least two phases, (i) a light phase comprising principally dissolved coal; solubilizing solvent; and a minor amount of solid, insoluble mineral ash and (ii) a heavy phase comprising substantially solid, insoluble mineral ash; solid, insoluble undissolved coal; and some solubilizing solvent, (d) subjecting the heavy phase to solvent recovery treatment for recycle of the solubilizing solvent and recovery of the solid, insoluble mineral ash and solid, insoluble undissolved coal, (e) subjecting the light phase to solvent recovery treatment for recycle of the solubilizing solvent and recovery of deashed coal product containing less than 0.16 weight percent of mineral ash.

5. The process of claim 4 wherein:

the weight ratio of solubilizing solvent to ash concentrate is within the range of from about 2 to about 6 parts by weight of solvent for each part by weight of ash concentrate.

6. The process of claim 4 wherein:

the weight ratio of solubilizing solvent to ash concentrate is within the range of from about 2½ to about 5 parts by weight of solvent for each part by weight of ash concentrate.

* * * * *